US011389942B1

(12) United States Patent
Stoltz et al.

(10) Patent No.: US 11,389,942 B1
(45) Date of Patent: Jul. 19, 2022

(54) SECURING MECHANISM FOR A SHAFT

(71) Applicant: SeaSpine Orthopedics Corporation, Carlsbad, CA (US)

(72) Inventors: Sarah Stoltz, Carlsbad, CA (US); Matthew Horner, Carlsbad, CA (US)

(73) Assignee: SeaSpine Orthopedics Corporation, Carlsbad, CA (US)

( * ) Notice: Subject to any disclaimer, the term of this patent is extended or adjusted under 35 U.S.C. 154(b) by 431 days.

(21) Appl. No.: 16/242,159

(22) Filed: Jan. 8, 2019

(51) Int. Cl.

| | |
|---|---|
| ***B25G 3/24*** | (2006.01) |
| ***B25G 1/00*** | (2006.01) |
| ***B25F 1/02*** | (2006.01) |
| ***B25B 23/00*** | (2006.01) |

(52) U.S. Cl.
CPC ..... *B25G 3/24* (2013.01); *B25B 23/0007* (2013.01); *B25F 1/02* (2013.01); *B25G 1/00* (2013.01)

(58) Field of Classification Search
CPC ..... B25G 3/24; B25B 23/0007
USPC ..... 81/177.2, 177.85
See application file for complete search history.

(56) References Cited

U.S. PATENT DOCUMENTS 1,269,413 A * 6/1918 Finnigan ..... B25B 23/0021 81/177.2
2,221,371 A * 11/1940 De Bethune ..... F16D 1/04 403/328
2,263,293 A * 11/1941 Ewald ..... F16L 37/40 251/149.6
5,255,993 A * 10/1993 Kovacs ..... F16B 7/042 403/316
5,495,878 A * 3/1996 McKenen, Jr. ..... B25D 1/16 144/193.1
5,941,577 A * 8/1999 Musellec ..... F16L 37/0841 285/317
6,139,214 A * 10/2000 Zirps ..... A61B 17/162 403/24
6,935,436 B1 * 8/2005 Williston ..... B23B 31/1078 173/132
7,316,425 B2 * 1/2008 Poder ..... F16L 37/0841 285/305
7,740,249 B1 6/2010 Gao
7,810,817 B1 10/2010 Gao
8,671,799 B2 * 3/2014 Chen ..... B62M 3/08 74/594.4
8,764,025 B1 7/2014 Gao
8,985,593 B1 3/2015 Gao
9,027,219 B2 5/2015 Gauthier et al.
9,271,705 B2 3/2016 Vaughn
2008/0016990 A1 * 1/2008 Rinner ..... A61B 17/8875 81/467
2018/0015597 A1 1/2018 Gauthier et al.

* cited by examiner

*Primary Examiner* — Hadi Shakeri
(74) *Attorney, Agent, or Firm* — Middleton Reutlinger

(57) ABSTRACT

A securing mechanism for releasably securing various implements and shafts to a hand tool, instrument, or device. The securing mechanism may include a button to unlock/lock the shaft relative to the device. The retention feature may include a cam surface. The retention feature may include a biasing member. The tool may include an orientation feature.

20 Claims, 8 Drawing Sheets

SECURING MECHANISM FOR A SHAFT

BACKGROUND

The present embodiments relate to a securing mechanism for receiving a variety of shafts, and more specifically for releasably securing various implements and shafts to a hand tool, instrument, or device.

A typical hand tool is designed for a variety of uses to enable users to perform various tasks. These tools include handles that may be grasped by the individual in order to more securely operate the tool. A number of tools of this type include various mechanisms that enable the tool to have a number of different implements having an attachment shaft attached to the tool. These mechanisms enable the shaft of the implement to be attached to the tool and utilized therewith in an interchangeable manner, allowing a single tool with multiple removable attachments to provide various functions. However, one of the drawbacks with mechanisms of this type is that the mechanism includes internal components translating axially and/or rotating relative to the body of the device (e.g. bearings), such that the contact and rigidity with the shaft may be reduced. Therefore, it is desirable to develop a securing mechanism for a tool that can be easily operated to secure and release various implements from the tool while maintaining desired contact with and/or transferring forces to the shaft when the tool is manipulated (e.g. axially and/or rotationally) by the individual in use.

SUMMARY

In some embodiments, a tool may have a securing mechanism for attaching a shaft of an implement to the tool. In various embodiments, the tool may include a tool body having an end opening configured to releasably receive the shaft. In addition, in various embodiments, the tool body may include an opening transverse and intersecting the end opening. In some embodiments, the tool may include a push button slidable within the opening between a locked position with the shaft and an unlocked position with the shaft. In various embodiments, the push button may include one or more protrusions adapted to engage the shaft in the locked position and disengage from the shaft in the unlocked positon.

In addition, in some embodiments, the tool may include at least one biasing member positioned between the push button and the tool body. In various embodiments, the one or more protrusions may include one or more cam surfaces positioned proximal the end opening of the tool body. In some embodiments, the push button may include an internal cavity. In addition, in some embodiments, the internal cavity may include the one or more protrusions projecting inwardly therefrom. In various embodiments, the tool may further include a sliding engagement between the push button and the opening of the tool body. Moreover, in some embodiments, the sliding engagement may be one or more pin and slot engagements. In various embodiments, the one or more protrusions may be arcuate in shape. In some embodiments, the one or more protrusions may include one or more concave walls. In various embodiments, the push button and/or the tool body may include one or more orientation features adapted to engage the shaft and orientate the tool in one or more orientations relative to the shaft.

In some embodiments, a tool may have a securing mechanism for attaching a shaft of an implement to the tool. In various embodiments, the tool may include a tool body having an end opening configured to releasably receive the shaft. In some embodiments, the tool body may include an opening transverse and intersecting the end opening. In some embodiments, the tool may include a push button slidable within the opening, wherein the push button translates between a locked position with the shaft and an unlocked position with the shaft. In addition, in various embodiments, the push button may include an internal cavity. In some embodiments, the internal cavity may include one or more protrusions projecting inwardly therefrom. In various embodiments, the tool may include one or more biasing members positioned between the push button and the tool body thereby urging the one or more protrusions inwardly towards the shaft to the locked positon.

In addition, in some embodiments, the one or more protrusions may include one or more cam surfaces positioned proximal the end opening of the tool body. In various embodiments, the internal cavity may be a through opening, wherein the through opening may be defined by a substantially arcuate wall with the one or more protrusions projecting inwardly into the through opening from the arcuate wall. In some embodiments, the tool may further include one or more cleaning ports extending from an outer wall of the tool body to an inner wall of the end opening and/or the opening of the tool body. In various embodiments, the one or more protrusions may be proximal a bottom wall of the opening. In addition, in some embodiments, the one or more protrusions may include one or more arcuate walls at a distal free end spaced from the internal cavity and adjacent the shaft. In various embodiments, the tool may further include a pin and slot engagement between the push button and the tool body. In some embodiments, the one or more protrusions may include a planar surface opposite a cam surface of the one or more protrusions. In various embodiments, when in the locked position, the planar surface contacts and restricts axially removal of the shaft from the end opening of the tool body.

In some embodiments, a tool may have a securing mechanism for attaching a shaft of an implement to the tool. In various embodiments, the tool may include a tool body adapted to releasably receive the shaft. In some embodiments, the tool may include a biased retention feature having a retention abutment surface opposite a cam surface, wherein the retention abutment surface interferes with the axial removal of the shaft from the tool body and the cam surface translates the biased retention feature outwardly allowing insertion of the shaft.

In addition, in some embodiments, the retention abutment surface may be substantially planar. In various embodiments, the biased retention feature may include a concave distal free end between the cam surface and the retention abutment surface. In some embodiments, the tool may include a pin and slot engagement allowing translation of the biased retention feature into and out of engagement with the shaft. Moreover, in some embodiments, the retention abutment surface may contact from an outer diameter towards an inner diameter of an axial facing planar surface of the shaft and interferes with the axial removal. In some embodiments, the tool may further include a button, wherein the button includes the biased retention feature.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
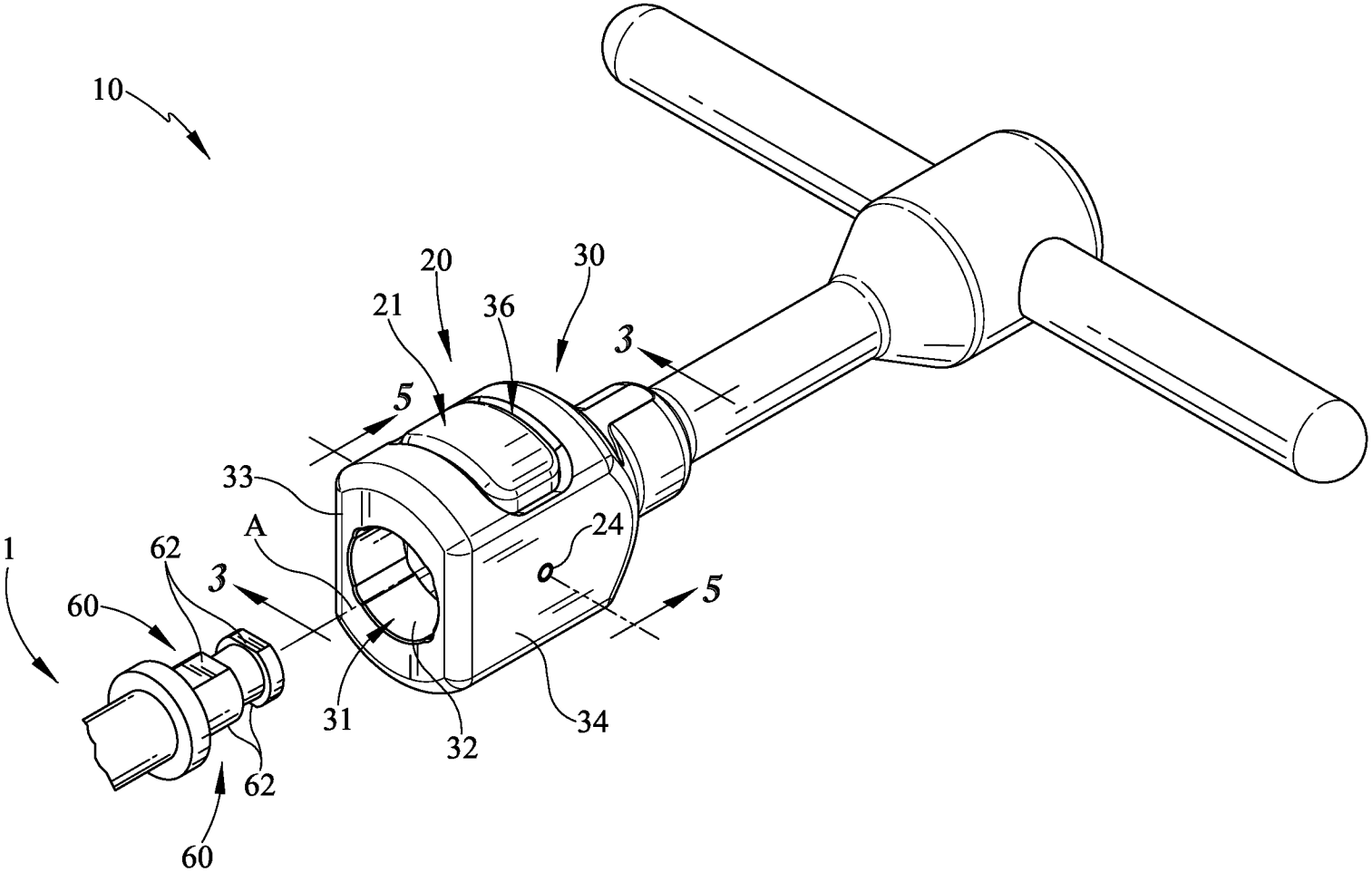
FIG. 1 is a perspective view of an embodiment of a tool with a shaft exploded away.

Numerous variations and modifications will be apparent to one of ordinary skill in the art, as will become apparent from the description below. Therefore, the invention is not limited to the specific implementations discussed herein.

As shown in the Figures, one or more securing mechanisms 20 may be used with the tool or device 10 to releasably secure the implement or shaft 1. The securing mechanism 20 may be configured for a variety of instruments connecting to one or more shafts or implements 1, not limited to the herein described apparatus. For example, one embodiment of the tool or device 10 may be a T-handle (FIGS. 1-7). In other embodiments, the tool or device 110 may be a Slap Hammer (FIG. 8), handles, inserters, instruments with depth stops, disassembleable instruments, modular instruments, or a variety of other devices may be secured to the same shaft end, another shaft, or instrument implement. The securing mechanism 20 may allow one or more devices 10 to quickly connect to a shaft or other implement 1. The shaft 1, for example, may be inserted with or without activating the button or user control 21 of the tool 10. The securing mechanism 20 engages the shaft structure (e.g. pocket, annular groove, etc.) and may prevent or reduce axial and/or rotational translation of the shaft 1. In various embodiments, the shaft features may correspond to other features of a body 30 of the device and may assist with one or more orientations and/or prevent shaft rotation. The securing mechanism 20 may be activated to release or unlock from the shaft allowing the user to separate the device from the shaft and/or reposition to another orientation.

Figure 5:
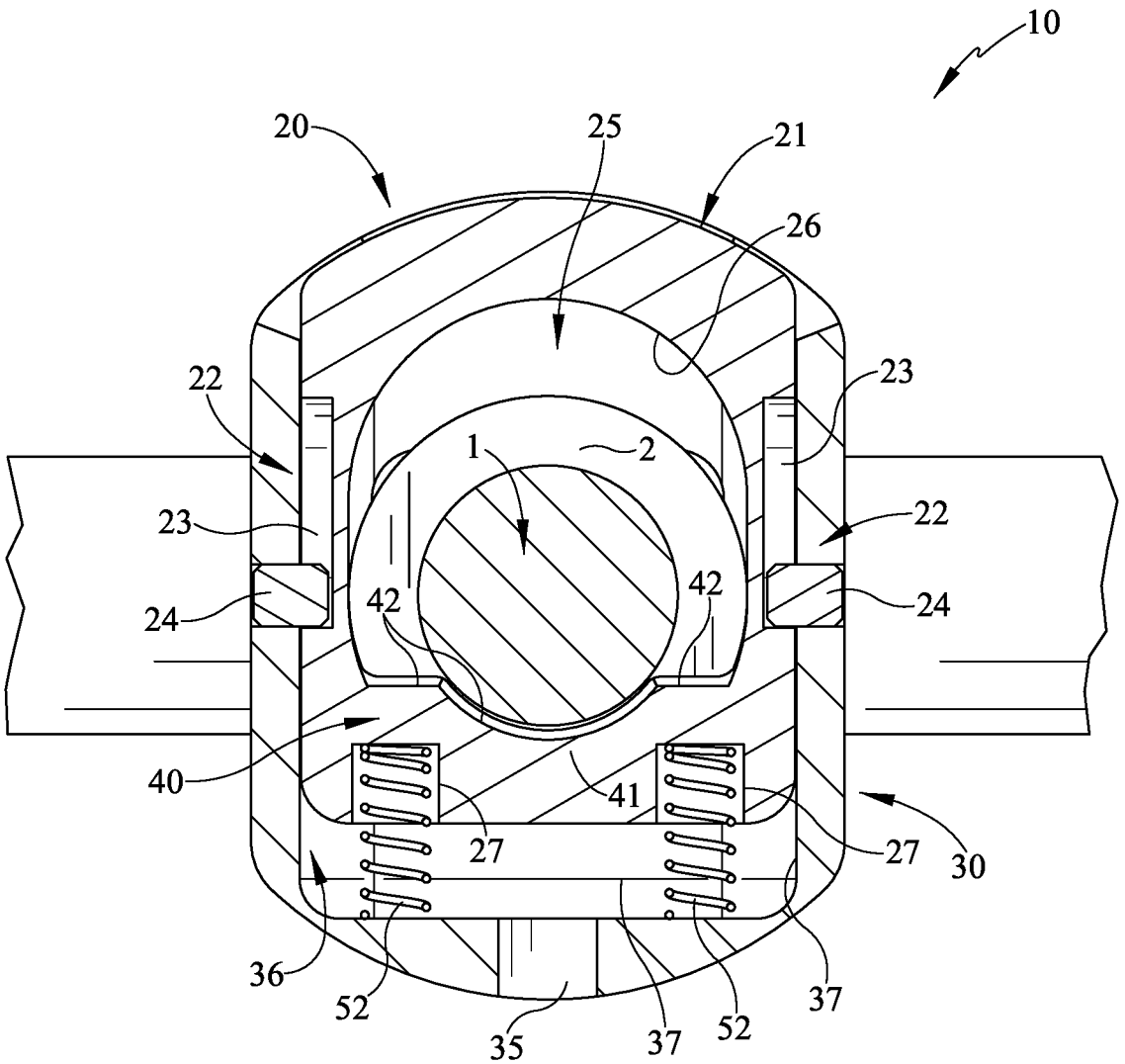
FIG. 5 is a sectional view of the tool taken along 5-5 of FIG. 1 illustrating the locked position.

The securing mechanism 20 releasably attaches the one or more implements with the remaining portion or tool body 30 of the one or more tools 10. The securing mechanism and/or retention device 20 may be configured between an unlocked position (FIG. 6) and a locked position (FIG. 5). When in the unlocked position, the implement/shaft 1 may be released from or removed/inserted (e.g. axially/rotationally) relative to the tool body. When in the locked position, the implement/shaft may be fixed in position relative to the tool body 30 (e.g. axially/rotationally). In the locked position, one or more retention features 40 may engage the shaft 1. Correspondingly, in the unlocked position, the one or more retention features 40 may disengage from the shaft 1. The retention feature 40 may be unbiased in a direction, although it is shown as biased (e.g. springs) in the figures. The release or control for the securing mechanism 20 may be a button 21 (e.g. push and/or pull) as shown in the embodiments. The button 21 and/or retention feature 40 may translate (e.g. slidable or sliding engagement) into and/or out of engagement with the shaft 1. The translation may be linear in some embodiments. As shown in the embodiment, the button 21 and/or retention feature 40 may translate perpendicular to the shaft 1, end opening 31, or longitudinal axis A.

Figure 3:
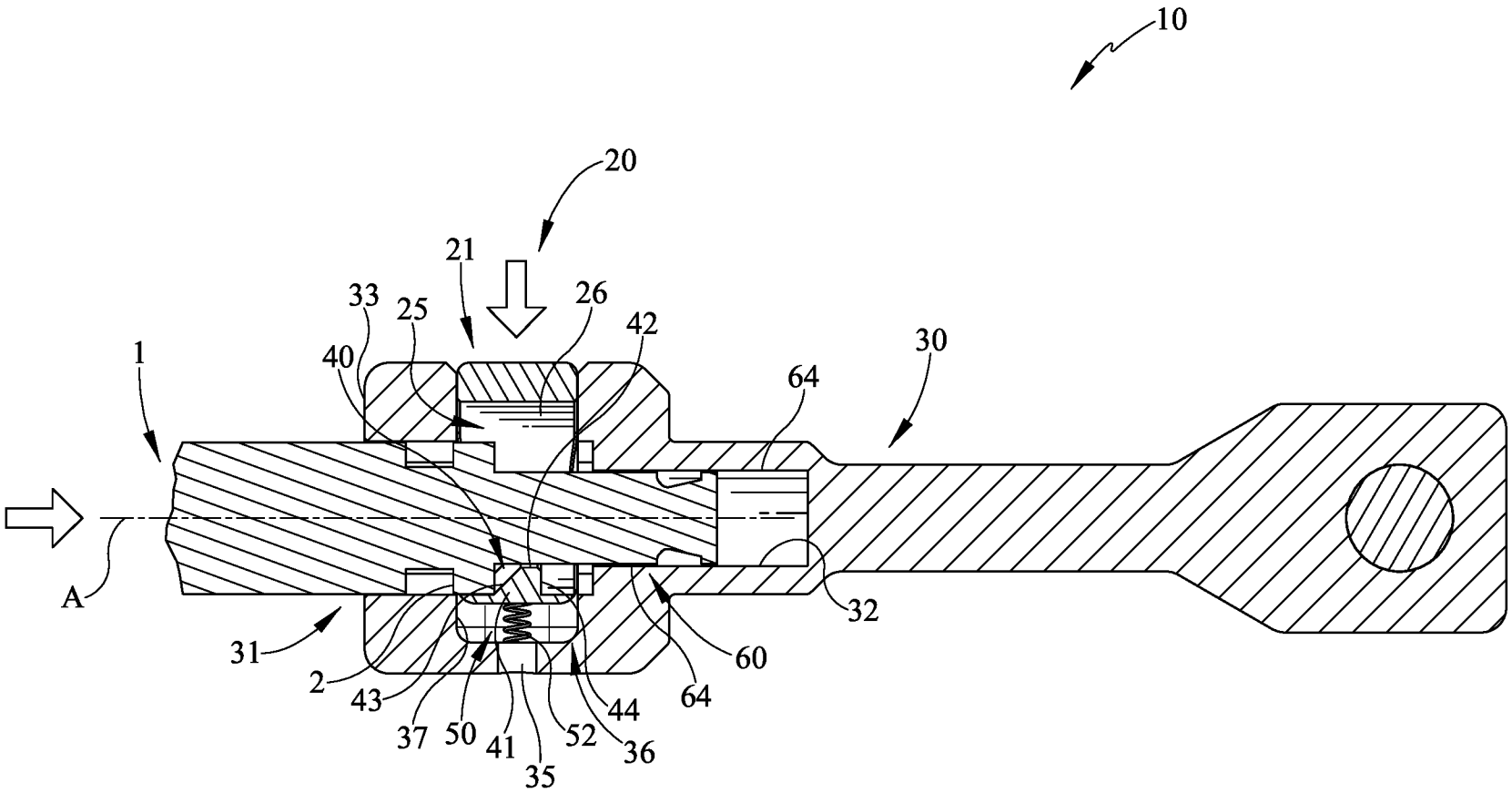
FIG. 3 is a sectional view of the unassembled and unlocked tool taken along line 3-3 of FIG. 1 illustrating the shaft initially contacting a cam surface to translate the biased retention feature during inserting of the shaft.
Figure 4:
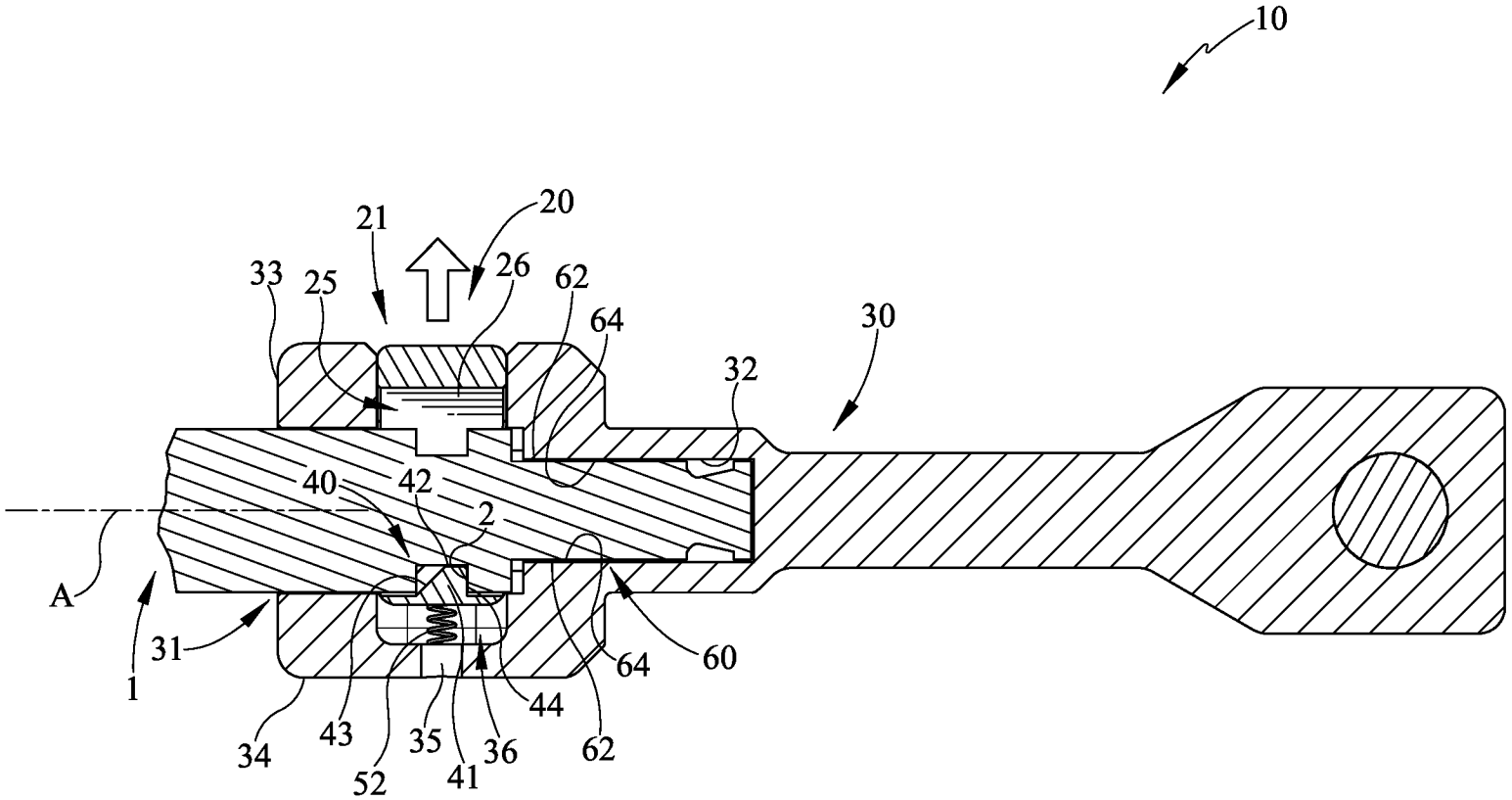
FIG. 4 is a sectional view of the assembled and locked tool taken along line 3-3 of FIG. 1 illustrating a locked position of the securing mechanism with the shaft.

The tool, driver, or device 10 may be of a variety of sizes, shapes, quantities, and constructions and still receive the implement structure or shaft 1. As shown in the figures, the tool body 30 may include an elongated end opening 31 defined by an interior wall or cavity 32. The end opening 31 may be positioned at one end 33 of the body 30. The end opening 31 may be configured to releasably receive the shaft 1. The body 30 may have the interior or inner wall 32 that may be cylindrical in various embodiments. The body 30 may have an exterior or outer wall 34 that may be cylindrical in some embodiments. The exterior wall 34 and interior wall 32 may be coaxial with the axis A. The interior wall 32/end opening 31/internal cavity 24 do not have to be circular in construction. It should be understood that a variety of shapes and sizes of the shaft receiving end openings 31 of the tool may be used and still match a variety of shaft geometry. The body 30 may have one or more drain holes or cleaning ports 35. As shown in FIG. 3, the cleaning port 35 may extend from one or more exterior walls 34 to one or more interior walls 32 (e.g. a wall of opening 36 receiving the button 21 and/or end opening 31).

Figure 6:
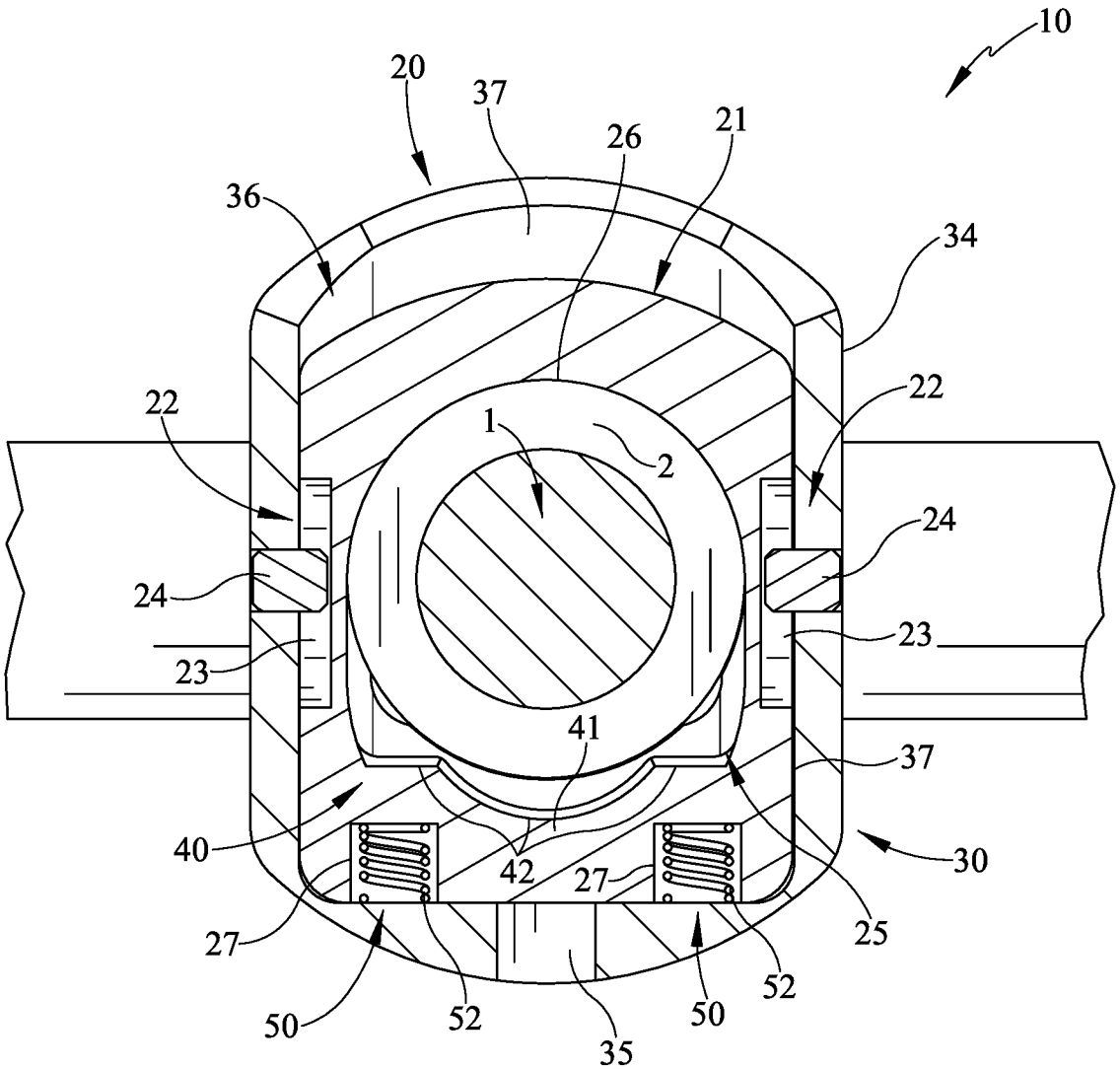
FIG. 6 is a sectional view of the tool taken along 5-5 of FIG. 1 illustrating the unlocked position of the securing mechanism.
Figure 7:
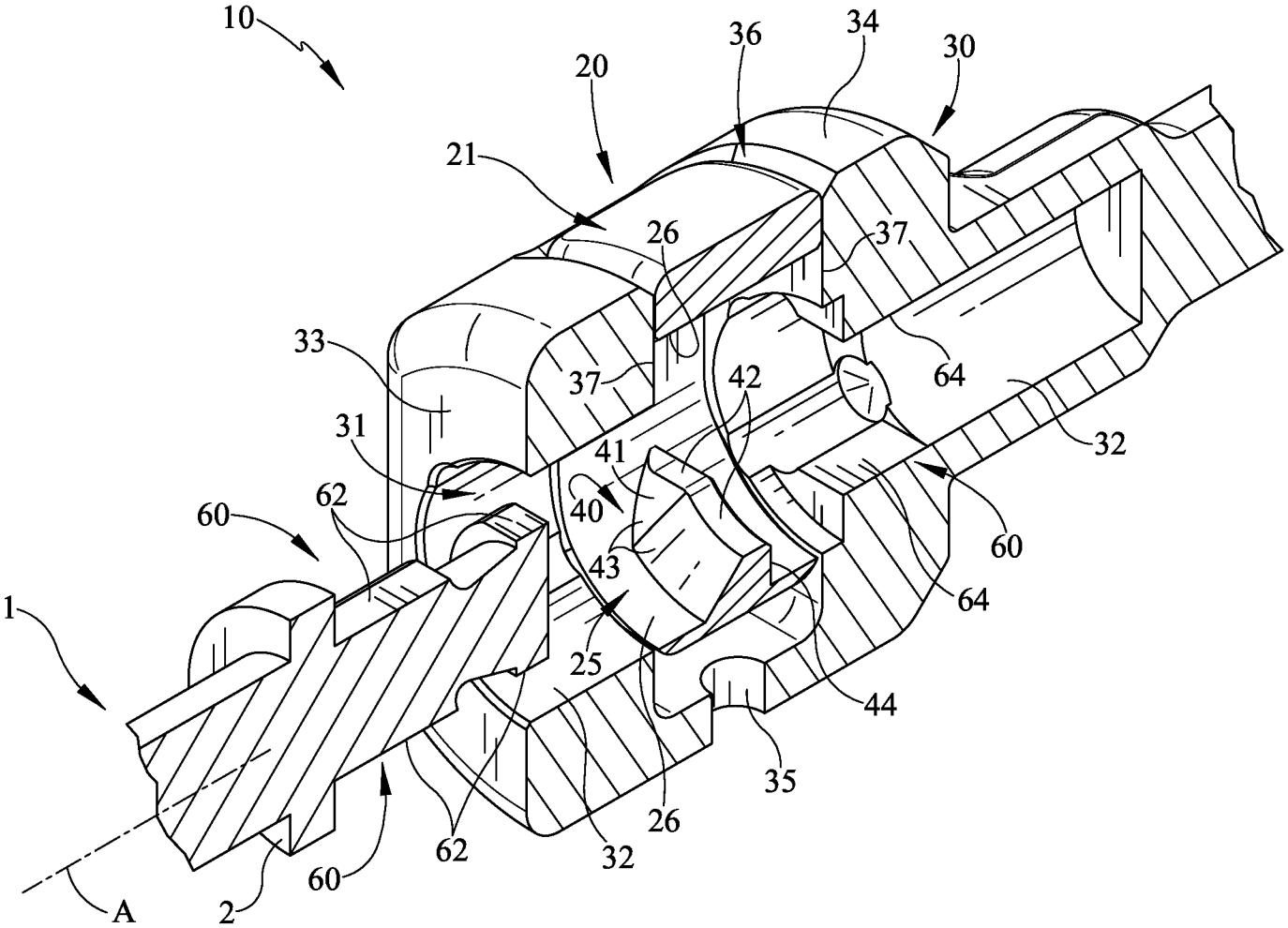
FIG. 7 is a perspective sectional view of the tool of FIG. 1 illustrating the unlocked position of the securing mechanism.

In some implementations, the securing mechanism control (e.g. push button 21) may operably engage the shaft within the end opening 31 of the tool body 30. The tool body 30 may include an opening 36 receiving the push button 21. The push button 21 may be in a sliding engagement within the opening 36 between the one or more locked positions and the unlocked positions. The push button 21 and/or opening 36 may intersect the end opening 31 of the tool body 30. The opening 36 may be positioned transverse (e.g. perpendicular) to the axis A or end opening 31. The push button 21 slides within the opening 36 between at least one locked position (FIGS. 4 and 5) and at least one unlocked position (FIGS. 3, 6, and 7). The push button 21 may include the biased retention feature 40 or protrusion 41.

Figure 2:
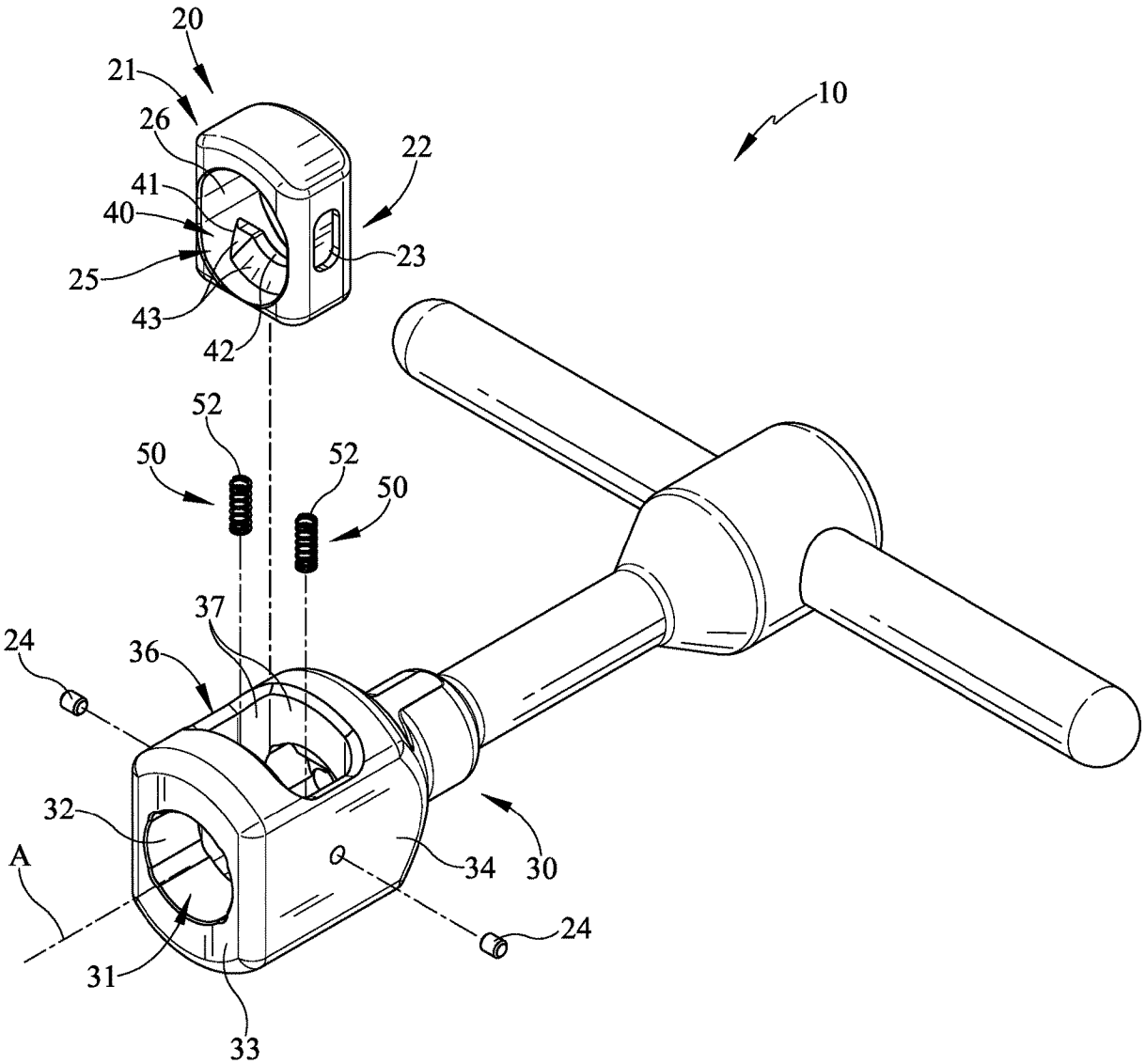
FIG. 2 is an exploded perspective view of the tool of FIG. 1.

In some embodiments as shown in FIGS. 2, 5, and 6, the sliding engagement of the securing mechanism 20 may include one or more pin and slot engagements 22. The push button 21 and tool body 30 may include the sliding engagement therebetween. In the embodiment shown, the push button 21 includes the one or more slots 23 on opposing exterior side walls. The slots 23 may be axially aligned with the direction of travel of the push button 21 between the locked and unlocked positions (e.g. perpendicular to the axis A). The pins 24 may project inwardly into the opening 36 from one or more inner walls 37 defining the opening 36 and operably engage the slots 23. The pins 24 may be inserted and/or positioned within the tool body 30 from the exterior wall 34 to the interior wall 37. The pins 24 may guide the travel of the push button 21 between the unlocked and locked positons. The pins 24 may be transverse to the axis A and the direction of travel of the push button 21. The slots 23 may extend along the exterior walls of the push button. The slots may extend transverse (e.g. perpendicular) to the longitudinal axis A. In other embodiments, the pin and slot engagement may be interchanged between the sliding structure. For example, the slots 23 may be on opposing walls 37 of the opening 36 of the body 30 while the pins 24 extend from the push button 21.

In some implementations, the securing mechanism 20 includes the one or more retention features 40. The push button 21 may include the one or more retention features 40 operably engaging the shaft 1 (e.g. annular one or more grooves of the shaft). The retention feature 40 may be one or more protrusions 41. The protrusion 41 may be adapted to engage and/or disengage from the shaft 1. The protrusion 41 may extend inwardly towards the shaft 1. As shown in FIGS. 2-7, the protrusion 41 may extend inwardly from one or more surfaces of an internal cavity 25 of the push button 21. The internal cavity 25 may receive the shaft 1 therethrough. The internal cavity 25 may be a through opening. The through opening may extend in the direction of the axis A. The through opening may be defined by a substantially arcuate wall 26. The one or more protrusions 41 may project inwardly in the through opening from the arcuate wall 26. In some embodiments, the protrusions may be on an exterior wall of the push button. The one or more protrusions 41 may be spaced about the internal cavity in a variety of positions. In the embodiment shown, the protrusion 41 may be proximal a bottom wall of the opening 36 or away from the user interface adjacent the exterior wall 34 of the tool body 30. The protrusion 41 may be arcuate in shape or concave. The distal free end 42, spaced from the internal cavity 25 (e.g. adjacent the shaft) may be concave in shape. The distal free end 42 may include one or more arcuate walls. The arcuate wall may be concave thereby contouring adjacent to the circumference of the shaft.

As shown in the figures, the tool 1 may include one or more biasing members 50. The one or more biasing members 50 may urge the retention feature 40 (e.g. one or more protrusions 41) towards the locked position to engage the shaft. The one or more biasing members 50 may urge the button 21 and/or protrusion 41 inwardly towards the shaft and locked position. The biasing member 50 may be positioned between the push button 21 and the tool body 30. In some embodiments as shown, the biasing members 50 may be a spring 52 (e.g. pair of springs). The springs 52 may be positioned adjacent the bottom wall of the opening 36. The spring 52 may be received at least partially in an aperture 27 in the push button 21. It should be understood that a variety of biasing members may be used and still create a biased retention feature 40. In some embodiments, a biasing member 50 may not be used. For example, the button 21 may be pushed and/or pulled by the user to releasably secure the shaft in some embodiments.

In some implementations, the retention feature 40 may include one or more cam surfaces 43. The button 21 may include the cam surface or chamfer 43 to allow the shaft 1 to be engaged or locked with the button 21 without the user pushing/pulling the button. The button 21 may need to be pressed to engage the shaft if the cam surface is not used in some embodiments. If used, as shown in FIG. 3, the cam surface 43 may translate the biased retention feature 40 or protrusion 41 outwardly away from the shaft (e.g. sliding the button within opening 36) allowing insertion of the shaft towards the locked position. Once the shaft passes over the cam surface 43, the biasing member 50 will urge the protrusion 41 inwardly into the shaft to axially retain the shaft's position relative to the tool body 30. The protrusion 41 may include the one or more cam surfaces 43. The cam surface 43 may be positioned proximal the end opening 31 of the tool body 30 or facing towards end 33 of the body 30. The cam surface 43, if used, may be opposite the one or more retention abutment surfaces 44 of the protrusion 41. The abutment surface 44 contacts one or more axial-facing surfaces 2 (e.g. planar) of the shaft (e.g. within annular shaft groove) and prevents removal or secures the shaft axially within the end opening 31. The abutment surface 44 interferes with the axial removal of the shaft 1 from the tool body 30. In some implementations, the concave distal free end 42 may be positioned between the cam surface 43 and the abutment surface 44. In the figures, the abutment surface 44 of the protrusion 41 is substantially planar. The planar surface may be transverse to the axis A. The planar surface of the abutment surface may include a distal edge that may be arcuate in shape adjacent the distal free end 42 or shaft 1. Similarly, the cam surface may include a distal edge that may be arcuate in shape adjacent the distal free end 42 or shaft 1. As shown more clearly in FIGS. 5 and 6, the retention abutment surface 44 may contact from an outer diameter towards an inner diameter of the axial facing planar surface 2 of the shaft. This increased surface area contacting therebetween in the locked position (FIG. 5) creates an engagement that may transfer force from the tool body 30/button 21 to the shaft 1.

In some implementations, the tool may include one or more orientation features. The orientation features 60, if used, may be adapted to engage the shaft and orientate the tool or portions thereof in one or more orientations relative to the shaft. In the one embodiment shown, the shaft or implement 1 includes one or more flats or orientation features 62 corresponding to one or more flats or orientation features 64 of the tool body 30. In some embodiments, the push button may include one or more orientation features. The orientation features may also provide for the shaft and tool body to rotate together if desired by the user.

In use, to engage the shaft, the shaft 1 enters the end opening 31 or tool body 30. The shaft forces the button 21 down via the cam surface 43 and passes through the through opening 25 of the button. If the cam surface is not used, the user may have to press the button downwardly to allow continued insertion upon abutting the protrusion 41. Once the groove of the shaft aligns with the protrusion 41, the protrusion is forced upwards into the groove of the shaft via the biasing members 50. An orientation feature 60, if used, of the shaft/tool body may orientate portions of the tool. The shaft may be locked until the user disengages the button from the shaft. When the button is pressed, the button retention feature or protrusion disengages from the shaft allowing the shaft to translate out of the end opening.

Figure 8:
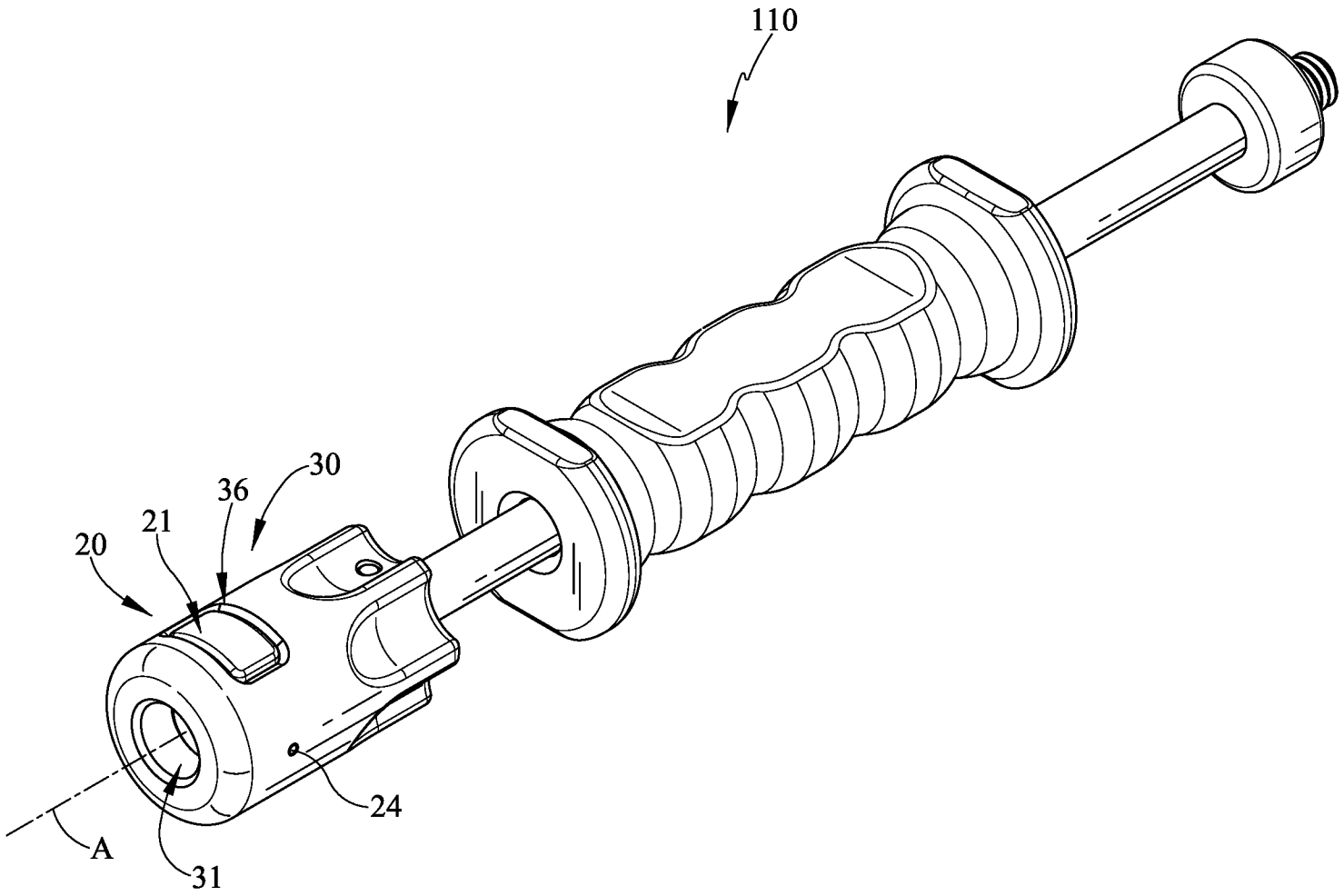
FIG. 8 is a perspective view of another embodiment of the tool having the securing mechanism.

FIG. 8 shows one embodiment of the securing mechanism with a Slap Hammer 110. When the securing mechanism 20 is in the locked position, the Slap Hammer tool 110 may allow for forward impaction and/or backward impaction. Forward impaction may apply or transmit force to the distal end of the shaft in contact with the bottom wall of the end opening or inner wall of the tool body. Backward impaction may apply or transmit force between the push button and the shaft. More specifically, the backward impaction force may be transmitted from the protrusion 41 (e.g. retention abutment surface) to the axial facing surface 2 of the shaft.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A combination of a slap hammer tool having a securing mechanism for attaching a shaft of an implement to the tool, the combination comprising:

the implement having the shaft with an axial facing surface spaced away from a distal end; and the slap hammer comprising a tool body and a mass translatable on the tool body, wherein the tool body includes an end opening configured to releasably receive the distal end of the shaft, wherein the end opening includes a bottom wall, and an opening transverse to and intersecting the end opening, and wherein the tool body includes one or more orientation features adapted to engage the shaft and orientate the tool body in one or more fixed orientations relative to the shaft;

a push button slidable within the opening between a locked position with the shaft and an unlocked position with the shaft; wherein the push button includes one or more protrusions adapted to engage the shaft in the locked position and disengage from the shaft in the unlocked position, and wherein the one or more protrusions include one or more cam surfaces positioned proximal the end opening of the tool body;

wherein at least one protrusion includes a distal free end, wherein the distal free end includes at least one concave wall recessed between opposing remaining portions of the distal free end of the at least one protrusion; and wherein the tool allows for forward impaction and backward impaction of the shaft of the implement, wherein backward impaction transmits force between the at least one concave wall and the opposing remaining portions of the distal free end of the at least one protrusion and the axial facing surface of the shaft, and wherein forward impaction transmits force between the distal end of the shaft in contact with the bottom wall of the tool body end opening.

2. The combination of claim 1 further comprising a biasing member positioned between the push button and the tool body.

3. The combination of claim 1 wherein the push button includes an internal cavity, the internal cavity includes the one or more protrusions projecting inwardly therefrom.

4. The combination of claim 1 further comprising a sliding engagement between the push button and the opening of the tool body, wherein the sliding engagement is one or more pin and slot engagements, wherein at least one pin and slot engagement of the one or more pin and slot engagements includes a pin and a slot, wherein the pin extends through a through opening extending from an exterior wall of the tool body to an interior wall of the tool body to project inwardly into the opening and into the sliding engagement with the slot within an exterior periphery of the push button.

5. The combination of claim 4 wherein the opposing remaining portions are perpendicular to a sliding direction of the push button in the sliding engagement with the opening of the tool body.

6. The combination of claim 1 wherein the at least one concave wall of the one or more concave walls engages an outer diameter of the shaft when in the locked position and the opposing remaining portions of the distal free end are disengaged from the outer diameter of the shaft when in the locked position.

7. The combination of claim 1 wherein the opposing remaining portions of the distal free end are not arcuate in shape.

8. The combination of claim 1 wherein the opposing remaining portions of the distal free end are parallel to each other.

9. A combination of a slap hammer tool having a securing mechanism for attaching a shaft of an implement to the tool, the combination comprising:

the implement having the shaft; and the slap hammer comprising a tool body and a mass translatable on the tool body, wherein the tool body includes an end opening configured to releasably receive the shaft, and an opening transverse and intersecting the end opening, and the end opening includes one or more orientation features adapted to engage the shaft and orientate the tool body in one or more fixed orientations relative to the shaft;

a push button slidable within the opening, wherein the push button translates between a locked position with the shaft and an unlocked position with the shaft;

wherein the push button includes an internal cavity and one or more apertures within in an exterior periphery, the internal cavity includes one or more protrusions projecting inwardly therefrom;

one or more biasing members positioned between the push button and the tool body thereby urging the one or more protrusions inwardly towards the shaft to the locked position, wherein the one or more biasing members is a spring having opposing ends, and wherein one end of the opposing ends is received by the one or more apertures within the exterior periphery of the push button and the other end of the opposing ends engages an interior wall defining the opening; and a sliding engagement between the push button and the opening of the tool body, wherein the sliding engagement is two opposing pin and slot engagements, wherein each of the two opposing pin and slot engagements include a pin and a slot, wherein the pin extends perpendicular to a longitudinal axis of the shaft through a through opening extending from an exterior wall of the tool body to an interior wall of the tool body to project inwardly into the opening and into the sliding engagement with the slot within an exterior periphery of the push button.

10. The combination of claim 9 wherein the one or more protrusions include one or more cam surfaces positioned proximal the end opening of the tool body.

11. The combination of claim 9 wherein the internal cavity is a through opening, wherein the through opening is defined by a substantially arcuate wall with the one or more protrusions projecting inwardly into the through opening from the arcuate wall.

12. The combination of claim 9 further comprising one or more cleaning ports extending from an outer wall of the tool body to an inner wall of at least one of the end opening and the opening of the tool body.

13. The combination of claim 9 wherein the one or more protrusions is proximal a bottom wall of the opening.

14. The combination of claim 9 wherein the one or more protrusions includes one or more arcuate walls at a distal free end spaced from the internal cavity and adjacent the shaft.

15. The combination of claim 9 wherein the one or more protrusions includes a planar surface opposite a cam surface of the one or more protrusions.

16. The combination of claim 15 wherein when in the locked position, the planar surface contacts and restricts axially removal of the shaft from the end opening of the tool body.

17. A combination of a tool having a securing mechanism for attaching a shaft of an implement to the tool, the combination comprising:

the implement having the shaft, wherein the shaft includes an annular groove and one or more first flats on opposing axial sides of the annular groove; and the tool comprising a tool body and a mass translatable on the tool body, wherein the tool body includes an exterior wall, interior wall, and an end opening defined by the interior wall adapted to releasably receive the shaft;

a push button having a biased retention feature;

wherein the biased retention feature includes a retention abutment surface opposite a cam surface, wherein the retention abutment surface interferes with the axial removal of the shaft from the tool body and the cam surface translates the biased retention feature outwardly allowing insertion of the shaft;

a pin and slot engagement allowing translation of the biased retention feature into and out of engagement with the shaft, wherein the pin and slot engagement includes a pin and a slot, wherein the pin extends through a through opening extending from the exterior wall of the tool body to the interior wall of the tool body to project inwardly into sliding engagement with the slot within an exterior periphery of the push button; and wherein the end opening of the tool body includes one or more second flats on opposing axial sides of the push button, wherein the one or more first flats of the implement shaft engage the one or more second flats of the tool body end opening to orientate the tool body in one or more fixed orientations relative to the shaft of the implement.

18. The combination of claim 17 wherein the retention abutment surface is substantially planar.

19. The combination of claim 17 wherein the biased retention feature includes a concave distal free end between the cam surface and the retention abutment surface.

20. The combination of claim 17 wherein the retention abutment surface contacts from an outer diameter towards an inner diameter of an axial facing planar surface of the shaft and interferes with the axial removal.

* * * * *